2/5/85 XR 4,498,061

United States Patent [19]

Mörz et al.

[11] Patent Number: 4,498,061

[45] Date of Patent: Feb. 5, 1985

[54] MICROWAVE RECEIVING DEVICE

[75] Inventors: Günther Mörz, Ludwigsburg; Wilhelm Milcz, Remshalden, both of Fed. Rep. of Germany

[73] Assignee: Licentia Patent-Verwaltungs-GmbH, Frankfurt, Fed. Rep. of Germany

[21] Appl. No.: 355,116

[22] Filed: Mar. 5, 1982

[30] Foreign Application Priority Data

Mar. 7, 1981 [DE] Fed. Rep. of Germany ..... 3108758

[51] Int. Cl.[3] ..... H01P 1/17; H01Q 13/02; H01Q 19/19

[52] U.S. Cl. ..... 333/21 A; 343/756; 343/781 CA; 333/212

[58] Field of Search ..... 343/352, 756, 772, 781 CA, 343/785, 786, 363, 365; 333/21 A

[56] References Cited

U.S. PATENT DOCUMENTS

| | | | |
|---|---|---|---|
| 2,684,445 | 7/1954 | Eaton | 343/777 |
| 3,001,193 | 9/1961 | Marie | 343/365 |
| 3,059,186 | 10/1962 | Allen | 455/313 |
| 3,216,017 | 11/1965 | Moore et al. | 343/756 |
| 3,611,396 | 10/1971 | Jones, Jr. | 343/776 |
| 3,697,898 | 10/1972 | Blachier et al. | 333/21 A |
| 3,758,882 | 9/1973 | Mörz | 333/21 A |
| 3,778,717 | 12/1973 | Okoshi et al. | 455/129 |
| 4,178,574 | 12/1979 | Edens et al. | 343/756 |

FOREIGN PATENT DOCUMENTS

| | | |
|---|---|---|
| 1056210 | 4/1959 | Fed. Rep. of Germany . |
| 1918084 | 10/1970 | Fed. Rep. of Germany . |
| 2329555 | 12/1974 | Fed. Rep. of Germany . |
| 2645700 | 4/1978 | Fed. Rep. of Germany . |
| 1540513 | 9/1968 | France . |
| 1562149 | 4/1969 | France . |
| 56-83101 | 7/1981 | Japan . |
| 416763 | 1/1967 | Switzerland . |
| 1080546 | 8/1967 | United Kingdom . |

OTHER PUBLICATIONS

H. Wollenhaupt, "Kompakte Cassegrain-Antenne für kleine Satelliten-Bodenstationen" *Nachrichtentechnische Zeitschrift NTZ*, vol. 34, (1981), pp. 576–577.

*Primary Examiner*—Theodore M. Blum
*Assistant Examiner*—Gilberto Barrón, Jr.
*Attorney, Agent, or Firm*—Spencer & Frank

[57] ABSTRACT

A receiver for counterclockwise and clockwise circularly polarized microwave signals of the type comprising a receiving antenna with a feeder system, a polarization converter, a polarization filter and a circuit for converting the microwave signals of both polarization directions from the high frequency to the intermediate frequency plane. A portion of the feeder waveguide belonging to the feeder system of the receiving antenna is designed as a bandpass filter which is effective for both polarization directions. A microstripline substrate, which carries the frequency converting circuit, is connected with the output of the feeder waveguide and is provided with an arrangement for coupling in the energies of the waveguide modes of both polarization directions. The polarization converter is either directly integrated in the feeder waveguide or the polarization conversion is effected by coupling the waveguide modes into the microstripline circuit.

22 Claims, 8 Drawing Figures

MICROWAVE RECEIVING DEVICE

BACKGROUND OF THE INVENTION

The present invention relates to a microwave receiver for counterclockwise and clockwise circularly polarized microwave signals, the receiver comprising a receiving antenna with a feeder waveguide, a polarization converter, a polarization filter and circuit for converting the microwave signals of both polarization directions from the high frequency plane to the intermediate frequency plane.

Conventional microwave receivers generally are designed in the following manner. Usually, the antenna is followed by the polarization converter and the polarization filter, both in the form of hollow waveguides. Each one of the two arms associated with the different polarization directions of the polarization filter is followed by a receiving circuit branch including a frequency converter. Each frequency converter is preceded by a bandpass filter in the form of a hollow waveguide which is connected to the polarization filter and to a low-noise preamplifier. Finally, the frequency converter is followed by an image-frequency suppression filter and an intermediate frequency amplifier. If the preamplifier, frequency converter, image-frequency suppression filter and intermediate frequency amplifier are provided in the form of an integrated microwave circuit, transitions are required from the hollow waveguide bandpass filters to microstriplines.

Such a conventional microwave receiver is not suited for use in a television satellite home receiving system, which is of particular interest here, since the above-described conventional receiver has a much too complicated, and therefore too expensive, structure. Moreover, it is not designed to have the smallest possible spatial dimensions.

SUMMARY OF THE INVENTION

It is therefore the object of the invention to provide a receiving device for doubly circularly polarized microwave signals which is designed with simple means and in a very compact form.

The above object is accomplished according to one basic enbodiment of the present invention in that in a microwave receiver for counterclockwise and clockwise circularly polarized waves of the type described above, a portion of the feeder waveguide in the feeder system of the receiving antenna is designed as a bandpass filter which is effective for both polarization directions; the frequency converter circuit is disposed on a microstripline substrate whose input is connected with the output of the feeder waveguide; the input of the microstripline substrate comprises means, disposed on the substrate, for coupling waveguide modes of both polarization directions, out of the feeder waveguide and into the frequency converter circuit; and the polarization converter is directly integrated in the feeder waveguide.

According to another basic embodiment of the present invention, instead of integrating the polarization converter into the feeder waveguide, the polarization conversion is effected when the energies of the waveguide modes are coupled out of the feeder waveguide and into the microstripline circuit.

Various arrangements for realizing the basic embodiments of the invention, as well as further advantageous features of the components of the receivers according to the invention, are likewise disclosed.

By integrating some circuit units in the feeder waveguide of the antenna and coupling the microstripline circuit to the feeder waveguide in a manner which simultaneously effects polarization separation and, under certain circumstances, also polarization conversion, a highly integrated receiver results. This provides a substantial advantage over the above-mentioned conventional receiver or receiving device which employs separate components for polarization conversion, polarization separation and waveguide to microstripline transitions, and consequently results in a long structural length.

DETAILED DESCRIPTION OF THE PREFERRED EMBODIMENTS

Figure 1:
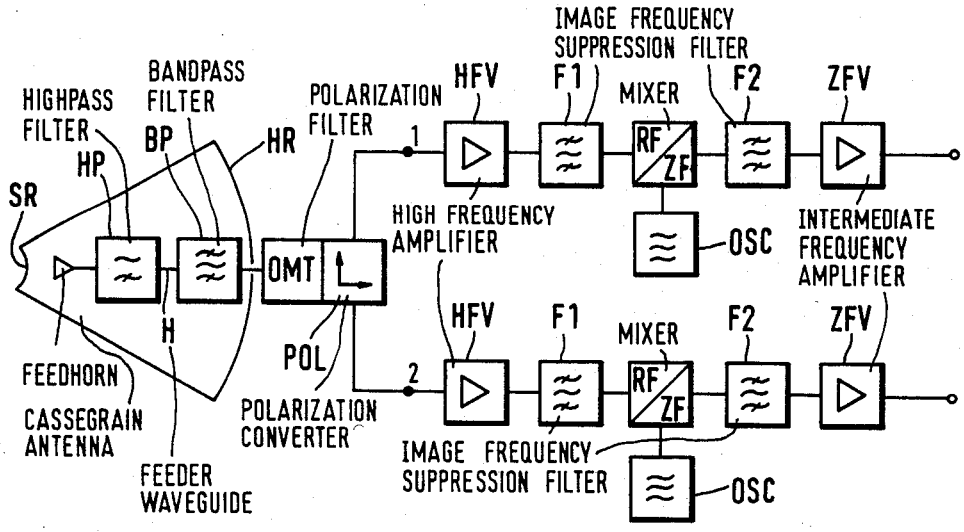
FIG. 1 is a block circuit diagram for a receiving device according to the invention having a separate receiving circuit branch for each direction of polarization.

The basic structure of a TV satellite home receiver is shown in the block circuit diagram of FIG. 1.

In the illustrated embodiment, the receiving antenna is a Cassegrain antenna having a subreflector SR and a main reflector HR. The feeder waveguide H of this antenna performs the function of a highpass filter HP and a bandpass filter BP for the microwave signals of both polarization directions. A polarization filter OMT (Orthomode transducer), a polarization converter POL and a respective receiving circuit branch for each polarization direction are connected directly to the feeder waveguide H. Each receiving circuit branch includes a high frequency preamplifier HFV, an image-frequency suppression filter F1 in the form of a bandpass filter, a frequency converter including a mixer RF/ZF and an oscillator OSZ for converting the high or radio frequency of the received signal to an intermediate frequency, a further image frequency suppression filter F2, and an intermediate frequency amplifier ZFV.

The receiver with two receiving circuit branches as shown in FIG. 1 permits simultaneous reception of, for example, television programs associated with clockwise as well as with counterclockwise circular polarization.

Figure 2:
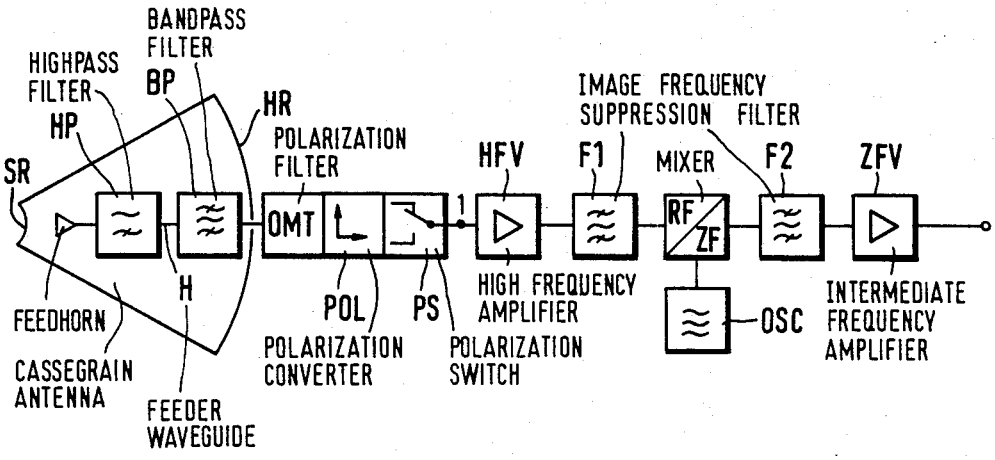
FIG. 2 is the block circuit diagram for a receiving device according to the invention having only one receiving circuit branch for both directions of polarization.

The reception of programs of only one polarization direction is possible with the receiver shown in FIG. 2, which can thus operate with only a single receiving circuit branch. This version is applicable if there exists a desire for a very inexpensive receiver involving as little circuitry as possible. In order to be able to switch this one receiving circuit branch alternatingly to clockwise or counterclockwise circularly polarized programs, a polarization switch PS is disposed ahead of the receiving circuit branch. All other circuit elements shown in FIG. 2 correspond to those of the block circuit diagram of FIG. 1.

In principle, the sequence of the highpass filter HP, the bandpass filter BP, the polarization filter OMT and the polarization converter POL selected for the embodiments of FIGS. 1 and 2 is not fixed. It is quite possible to interchange these circuit elements.

The portion of the circuit beginning with the antenna up to the terminals 1 and 2 which are followed by the receiving branches or branch in FIGS. 1 and 2, respectively, will now be described in greater detail. The receiving circuit branches themselves will not be discussed in detail since they may be designed according to the state of the art.

Figures 3A, 3B, 4A, 4B:
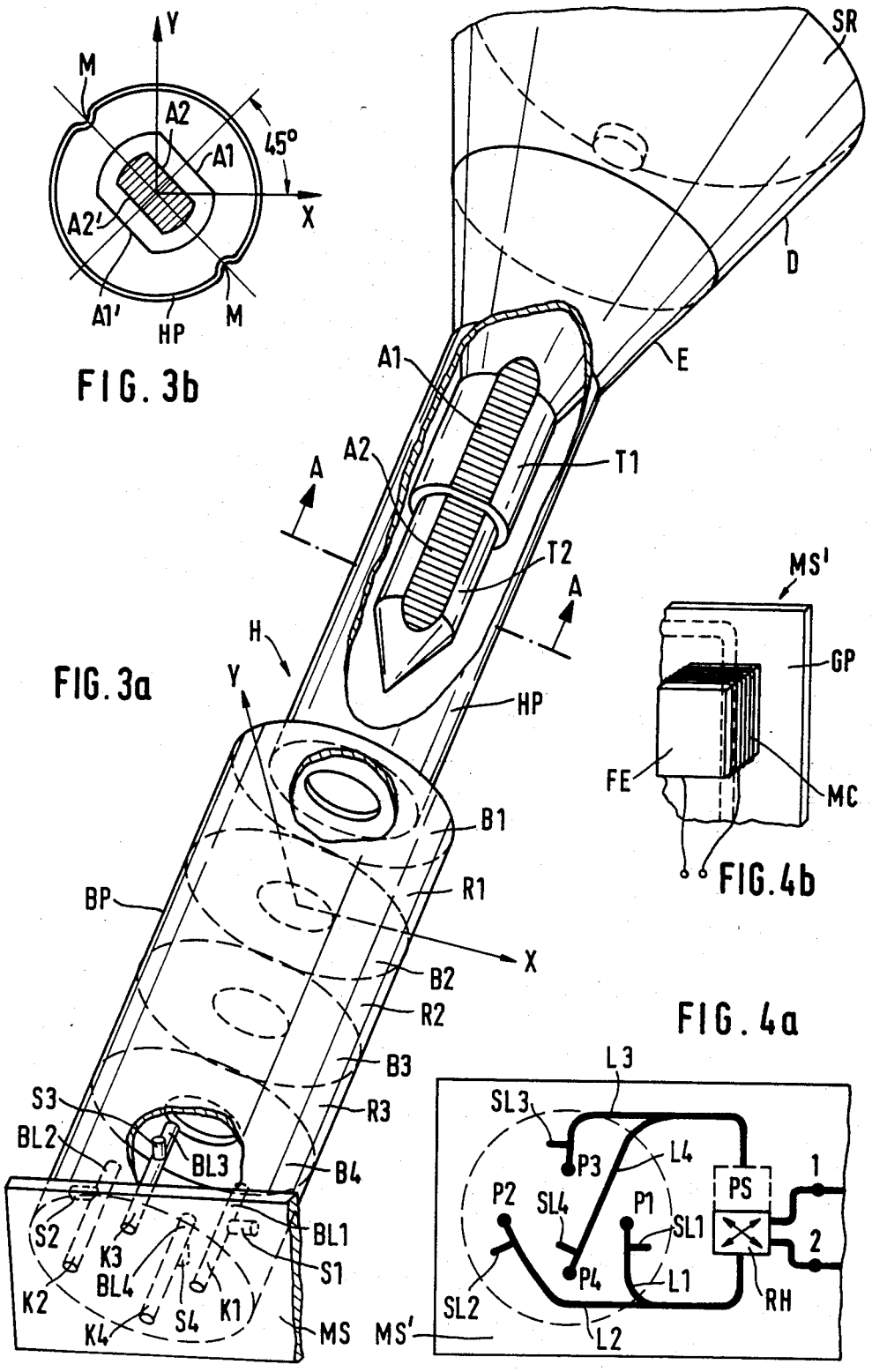
FIG. 3*a* is a perspective view, partially broken away, of a feeder waveguide with integrated feedhorn and subreflector for a Cassegrain receiving antenna according to one embodiment of the invention.
FIG. 3*b* is a cross-sectional view along the line A—A through the feeder waveguide of FIG. 3*a*.
FIG. 4*a* is a plan view of an embodiment of a portion of a microstripline circuit coupled to the end of the feeder waveguide.
FIG. 4*b* is a perspective view of a 180° phase shifter arranged on the microstripline circuit.

FIG. 3*a* is a perspective view of the feeder waveguide H for a receiving antenna designed according to the Cassegrain principle. The feeder waveguide H ends in a funnel-like feedhorn E in which there sits a dielectric, conical insert D. As disclosed, for example, in U.S. patent application Ser. No. 188,992, filed Sept. 22, 1980 by G. Nottebom et al, now abandoned, the end surface of this insert D is metallized and thus acts as the subreflector SR of the Cassegrain antenna. For impedance matching, the dielectric insert D is provided with two cylindrical $\lambda/4$ transformation members T1 and T2 which extend into the end of the feeder waveguide H. The transformation member T1 has a cross section which is reduced compared to that of the transformation member T2. Instead of two or a plurality of transformation members T1, T2 with graduated changes in cross section, it is also possible to use one transformation member which becomes continuously narrower toward the interior of the feeder waveguide H.

In the embodiment of FIG. 3, the two transformation members T1 and T2 simultaneously perform the function of a polarization converter which converts the received clockwise or counterclockwise circularly polarized waves into horizontally or vertically linearly polarized waves. For this purpose, the cylindrical transformation members T1 and T2 are each provided with two facing flattened portions A1, A1′ and A2, A2′, respectively, as shown more clearly in FIG. 3*b* which is a sectional view taken transversely through the feeder waveguide H along the line A—A of FIG. 3*a*. The flattened portions A1, A1′ and A2, A2′ are arranged such that the normals to their surfaces form an angle of 45° with the horizontal axis (X axis) or with the vertical axis (y axis), respectively, of the feeder waveguide H. The inherent ellipticity of the polarization converter can be influenced with the dimensions of the flattened portions, since the ellipticity curve plotted over frequency should be as shallow as possible. In view of this, the degree of dielectric fill of the waveguide H at the location of the transformation members T1, T2 must be selected such that optimum spacing of the operating frequency from the limit frequency of the waveguide H results. If this spacing between the two frequencies is too small or too large, the inherent ellipticity would clearly go into an oblique position and this would result in a considerable worsening of polarization decoupling.

The transformation members T1 and T2 may additionally be provided with thickened portions and/or twists, not shown in FIGS. 3*a* and 3*b*, to reduce inherent reflection coefficient.

If the polarization conversion is to take place at a different location in the receiver, the special design of the transformation members, i.e. the flattened portions A1, A1′ and A2, A2′, is not required.

The portion of the feeder waveguide H into which the transformation members T1 and T2 of the dielectric insert D extend is dimensioned such that it has the characteristics of a highpass filter. This highpass filter waveguide piece HP is dimensioned so that it has, on the one hand, a cutoff frequency which assures sufficiently high stopband isolation for the signal (e.g., 10.8 GHz) of the oscillator OSZ of the frequency converting circuit. On the other hand, the spacing of the cutoff frequency (e.g., 11.0 GHz) from the useful signal frequencies (e.g. 11.7 . . . 12.5 GHz) must not be too small since then the attenuation for the useful signals would be too great and the electrical parameters, as, for example, cross-polarization decoupling, would become too dependent upon the mechanical tolerances of the feeder waveguide H.

The highpass waveguide piece HP is followed by a further portion of the feeder waveguide H which is designed as a bandpass filter BP. As shown, this latter waveguide portion is designed, for example, as a three-circuit bandpass filter which has identical transmission characteristics in the horizontal (x) and vertical (y) oscillation directions. For this purpose, the waveguide portion is provided with four apertures B1 through B4, each provided with a circular coupling opening, which divide the waveguide portion into three resonator sections R1, R2 and R3. In order to produce special frequency curves of the coupling between the highpass filter HP and the first resonator section R1, or between the resonator sections themselves, the first aperture B1, or also the remaining apertures B2, B3, B4, may be provided with a coupling opening in the form of crossed slits.

The feeder waveguide H is terminated by a substrate MS which supports the microstripline circuit of the receiving circuit branch or branches. The end of the feeder waveguide H is soldered onto the ground plane of the substrate MS so as to be perpendicular thereto. In order to couple the energy of the waveguide modes into the microstripline, four coupling pins K1 to K4 are disposed on the substrate MS and extend into the feeder waveguide H. Two of these coupling pins (K1 and K2 in the illustrated embodiment) are disposed on the x axis of the waveguide H and the other two (K3 and K4) on the y axis of the waveguide H. Both axes are determined by the orthogonal axes where the coupling pins are arranged. The coupling pins K1, K2, K3 and K4 which project into the waveguide H in the axial direction, each have an end S1, S2, S3 and S4, respectively, which is bent at an angle radially to the wave propagation direction. Beyond this angled end, each coupling pin K1, K2, K3 and K4 also has an extension BL1, BL2, BL3 and BL4, respectively, which is oriented axially into the interior of the feeder waveguide H and which acts as a stub. These stubs BL1 to BL4 serve to provide broadband matching of the mode conversion.

The structural length of the three-resonator bandpass filter shown in FIG. 3*a* can be shortened in that the fourth aperture B4 is omitted and the resonator R3 is delimited, on the one hand, by the aperture B3 and, on the other hand, by the ground plane of the substrate MS so that the waveguide area provided for mode coupling simultaneously takes over the function of the third resonator R3.

FIG. 4*a* shows the surface of a substrate MS' opposite the ground plane surface which can be used with an antenna and feeder system according to the invention. In FIG. 4*a*, the base points of the coupling pins K1, K2, K3 and K4 which pass through the substrate MS' are shown at P1, P2, P3 and P4, respectively. The signals at two base points P1 and P2 or P3 and P4, respectively, which lie on the same axis—y axis or x axis, respectively—have a phase difference of 180° between one another. This phase difference must be corrected again when the signals at the base points, i.e. P1 and P2 or P3 and P4 are brought together. In the present embodiment this is done, as shown in FIG. 4*a*, by means of different lengths of line of the microstriplines L1, L2, L3 and L4 emanating from the respective base points P1–P4. However, the phase correction can also be effected, for example, in a known manner with 180° ring hybrids. The stub lines SL1, SL2, SL3 and SL4 branching off from the microstriplines L1, L2, L3 and L4, respectively, serve to compensate mismatchings.

Once the coupled-in energy components of the horizontally polarized waveguide mode and those of the vertically polarized waveguide mode have been combined in the correct phase through the microstriplines L1 and L2 or L3 and L4, respectively, the sum energy of the horizontally polarized field is fed to the one input and the sum energy of the vertically polarized field is fed to the other input of a 90° ring hybrid RH. Information from the clockwise circularly polarized received signal and from the counterclockwise circularly polarized received signal are then present at the two outputs of the 90° ring hybrid or 3 dB coupler, unless the feeder waveguide H is provided with its own polarization converter as in FIG. 3*a*. If such a polarization converter is provided, the 90° hybrid RH can be omitted and the oppositely polarized received signals are available once the conductors L1, L2 and L3, L4 have been joined in the correct phase.

It is also possible to link one base point on the horizontal axis with one base point on the vertical axis (e.g. P1 with P3 and P2 with P4) by means of microstriplines. A phase difference of 90° between the modes in the lines must then be compensated at the point of juncture of the microstriplines which can be effected by means of 90° ring hybrids or 3 dB couplers. Finally, from the energy components thus brought together, a 180° ring hybrid produces at its output unambiguous information from the clockwise or counterclockwise circularly polarized received signal. This again applies for the case where no polarization converter is provided in the feeder waveguide H.

If, as mentioned in connection with FIGS. 1 and 2, not two but only a single receiving circuit branch is provided, one input of the 90° ring hybrid RH or of a 3 dB coupler is preceded by a polarization switch PS in the form of a 0°/180° phase shifter (see FIG. 4*a* ). Depending on the switching state (0° or 180°) of the phase shifter, either the information of the clockwise circularly polarized input signal or the information of the counterclockwise circularly polarized input signal appears at one output of the ring hybrid RH. The second, superfluous output of the ring hybrid RH can be terminated by an absorber. The 180° phase shifter PS can be, for example, a premagnetized ferrite element FE which is disposed either above the microstripline leading to the ring hybrid RH or fastened to a point etched free of the ground plate GP on the rear face of the substrate. FIG. 4*b* shows a partial-view of the rear face of the substrate. The ferrite element element FE can here be metallized, except for the interface with the substrate, which permits simple soldering onto the substrate. The magnetization of the ferrite element can be switched by means of a magnetization coil MC having one or a plurality of turns through which flows a current pulse. The 180° phase shifter can also be realized by a switching circulator or a 3 dB directional coupler which can be switched by means of PIN diodes.

Figure 5:
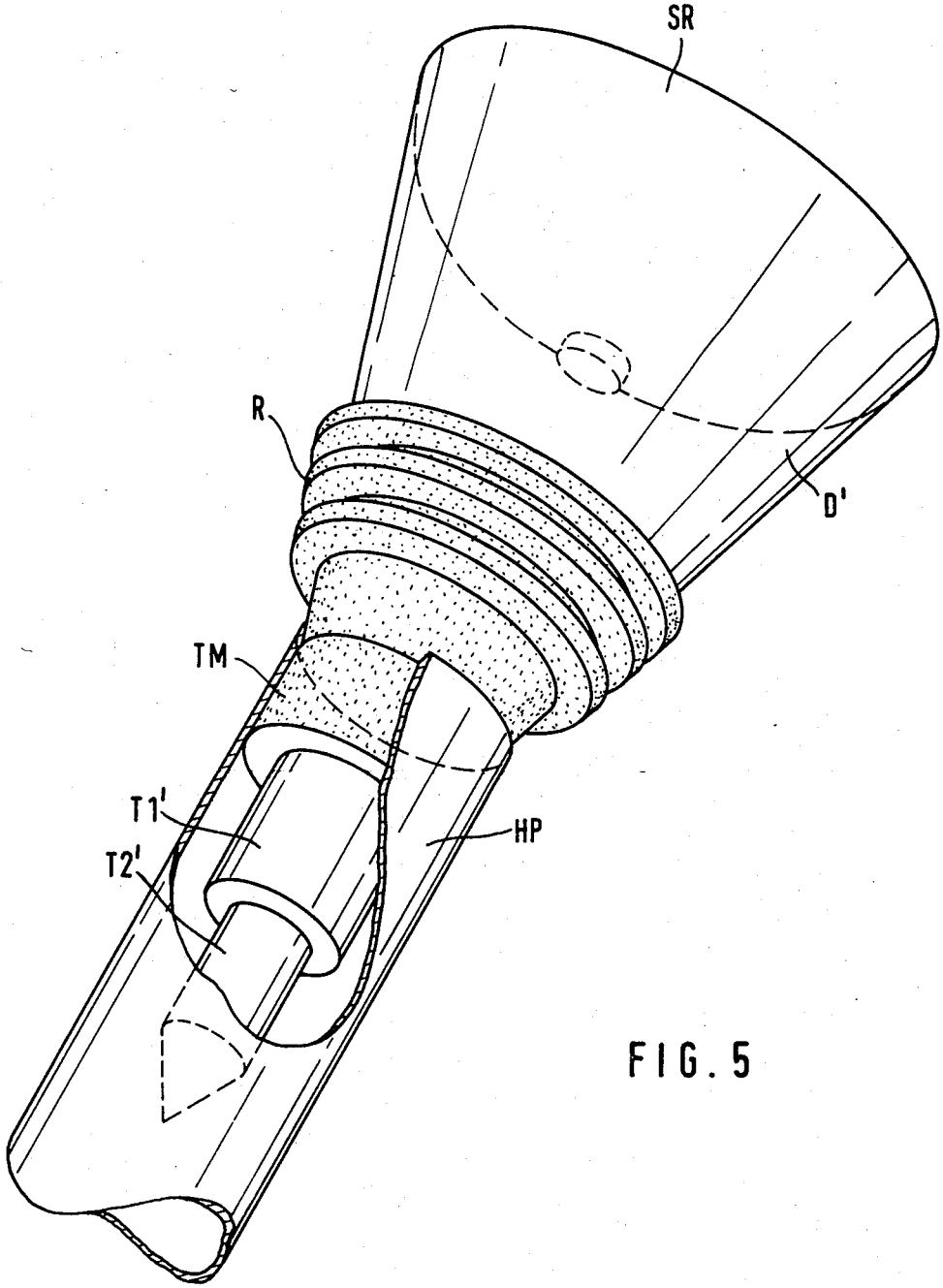
FIGS. 5 and 6 show two further embodiments according to the invention of feeder waveguides, each with integrated feedhorn and subreflector.

FIG. 5 shows another form of the feedhorn with which the cross-polarization characteristics of an antenna can be improved. The feedhorn E in the form of a smooth-walled funnel shown in FIG. 3 is here replaced by a corrugated horn whose advantageous characteristics with respect to cross-polarization are to be utilized. This corrugated horn is integrated with the dielectric insert D' whose end surface, as described above, is designed as the subreflector SR for the Cassegrain antenna. The groove structure R is applied to the initial region of the dielectric insert D' which protrudes from the highpass filter waveguide section HP. This groove structure R can be produced very economically together with the dielectric insert D' in a die-casting process. It is advisable to arrange the groove structure R perpendicularly to the axis of the insert D' and moreover to give the grooves a trapezoidal shape so that the workpiece can be separated from the die-mold more easily. The region of the dielectric insert D' provided with the groove structure R and a portion TM of the dielectric insert extending into the highpass filter waveguide section HP are coated with a metal layer which is shown in FIG. 5 by dots. The dielectric insert D' may be fastened in the highpass filter waveguide section HP by means of an adhesive applied on the metallized portion TM, which is cylindrical or slightly conical. This does not require electric contacting between the waveguide section HP and the metallization or metal coating if the adhesive layer is sufficiently thin. The dielectric insert D' again has two transformation members T1' and T2' which here, however, are not designed to produce polarization conversion, i.e. the transformation members are cylindrical. The insert D' may also be provided with a conical cavity which is terminated by a halfshell serving as the subreflector SR.

With such a design of the exciter it is possible to produce the electrically highly effective groove structure R in an extraordinarily economical manner.

An example of a corrugated horn is disclosed in the U.S. Pat. No. 3,413,642. But herein the groove structure is arranged in the metallic walls of the horn.

Figure 6:
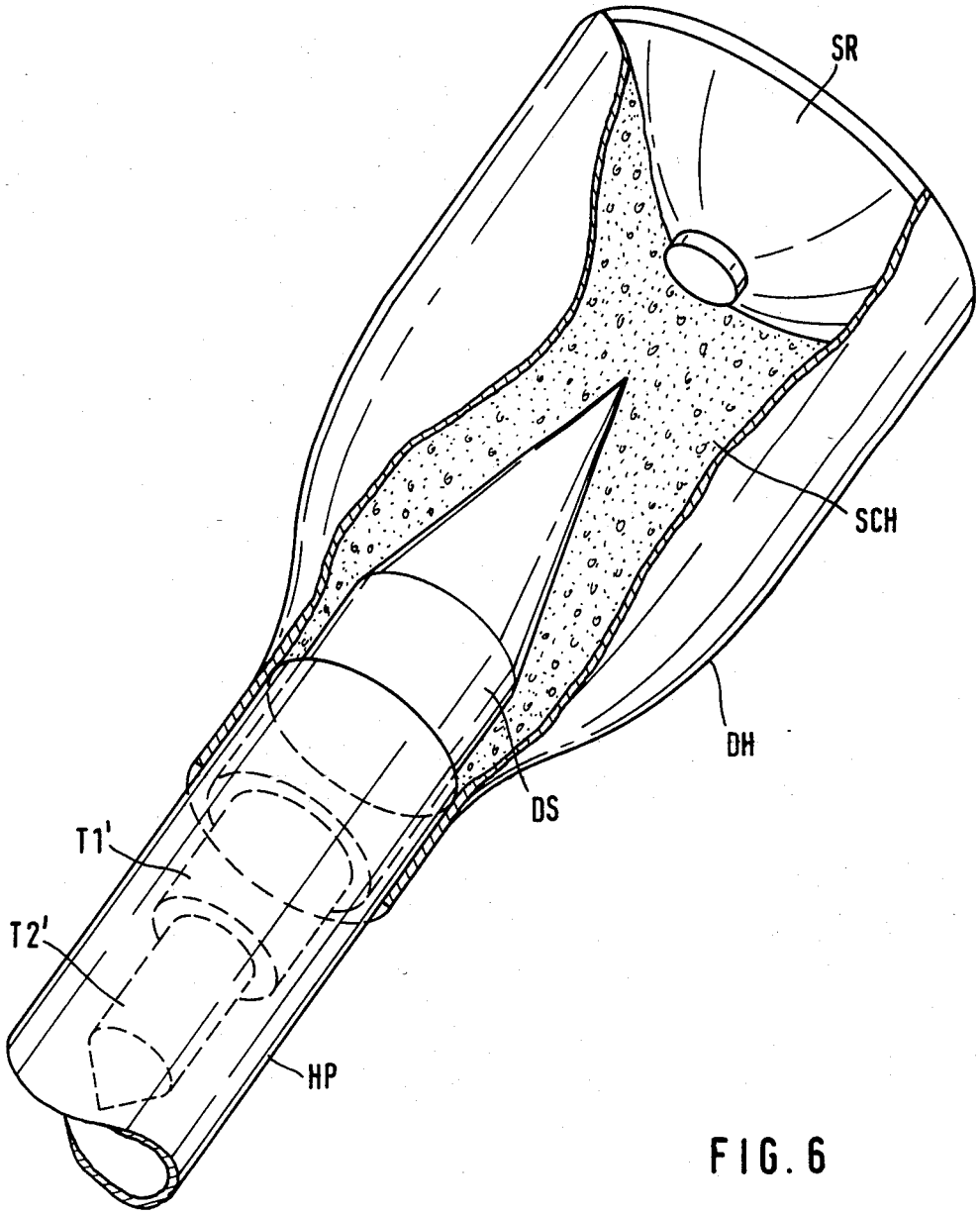

Another type of exciter is shown in FIG. 6. It evolved from the combination of the classical dielectric rod radiator with a dielectric mount for the subreflector SR. The dielectric rod radiator comprises a dielectric insert DS placed into the highpass filter waveguide section HP and equipped with transformation members T1' and T2'. The insert DS is tapered toward the subreflector SR. A stable dielectric sheath DH which supports the metallized subreflector shell SR is placed onto the high-pass filter waveguide section HP. The interior of this sheath DH may be filled with a lightweight foamed substance SCH which has a low dielectric constant. With such a feedhorn it is possible to realize very good cross-polarization characteristics, if there exists a sufficiently large difference between the dielectric constants of the material of the dielectric insert DS and of the foamed dielectric substance SCH. The insert DS, the sheath DH and the foam SCH have the following dielectric constants DS: $\epsilon \approx 2.4 \ldots 3.8$ DH: $\epsilon \approx 2.08 \ldots 3.8$ SCH: $\epsilon \approx 1.1$ The above-described integration of feeder waveguide, feedhorn and subreflector leads to a very compact structure of the exciter system.

Since it is the object to keep the costs for the above-described arrangement or arrangements as low as possible, a simple and quickly performed method of electrical matching will now be described, since such electrical matching usually takes up a major portion of the manufacturing costs. On the one hand, the receiver must have a high electrical quality, but on the other hand, it should be possible to omit the use of tuning screws. To meet such a requirement, the particularly tolerance sensitive components, such as, for example, the highpass filters HP and bandpass filters BP, are provided with tuning markers in the waveguide walls, for example by means of a computer controlled device. In this way it is possible to make corrections of the inherent ellipticity in the highpass filter waveguide section HP with the tuning markers M being applied, as shown in FIG. 3*b*, in pairs opposite one another under a suitable angle to the x or y axis, depending on the reason for the ellipticity. If there exists annoying cross-coupling of the oscillation planes which is to be eliminated by tuning these markers M must be applied at an angle of 45° or 135°. The application of such tuning markers M can be facilitated by a prefabricated weakening in the waveguide walls at predetermined points.

It will be understood that the above description of the present invention is susceptible to various modifications, changes and adaptations, and the same are intended to be comprehended within the meaning and range of equivalents of the appended claims.

What is claimed is:

1. In a receiver for counterclockwise and clockwise circularly polarized microwave signals comprising a receiving antenna with a feeder system including a feeder waveguide, a polarization converter for converting received circular to linear polarized signals, a polarization filter and a converter circuit means, connected to the output of said feeder system, for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions, and a further portion of said feeder waveguide is a highpass filter whose cutoff frequency is such that a sufficiently high stopband isolation exists for the oscillator signal of said converter circuit means; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter is directly integrated in said feeder waveguide.

2. In a receiver for counterclockwise and clockwise circularly polarized microwave signals comprising a receiving antenna with a feeder system including a feeder waveguide, a polarization converter for converting received circular to linear polarized signals, and a polarization filter, and a converter circuit means, connected to the output of said feeder system, for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions, and a further portion of said feeder waveguide is a highpass filter whose cutoff frequency is such that a sufficiently high stopband isolation exists for the oscillator signal of said converter circuit means; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter is included in said means for coupling the energies of the waveguide modes.

3. In a receiver for counterclockwise and clockwise circularly polarized microwave signals comprising a receiving antenna with a feeder system including a feeder waveguide, a polarization converter for converting received circular to linear polarized signals, a polarization filter and a converter circuit means, connected to the output of said feeder system, for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions, with said bandpass filter being formed by a plurality of coupling apertures which are disposed in said feeder waveguide and provided with coupling openings in the form of circles; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter is directly integrated in said feeder waveguide.

4. In a receiver for counterclockwise and clockwise circularly polarized microwave signals comprising a receiving antenna with a feeder system including a feeder waveguide, a polarization converter for converting received circular to linear polarized signals, a polarization filter and a converter circuit means, connected to the output of said feeder system for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions; said converter circuit means is disposed on a microstripline substrate whose input is connected with the output of said feeder waveguide; the output end of said feeder waveguide is disposed on and normal to the ground plane surface of said microstripline substrate and is electrically connected therewith; said input of said microstripline substrate comprises coupling means, disposed on said substrate, for coupling the energies of the waveguide modes of both polarization directions out of said feeder waveguide and into said converter circuit means; said coupling means includes a plurality of coupling pins which extend through said microstripline substrate and axially into said feeder waveguide and which have their base points connected to respective microstriplines disposed on the surface of said substrate opposite said ground plane surface, selected ones of said microstriplines emanating from said base points of said coupling pins being connected together to provide the information from the clockwise and counterclockwise circularly polarized received signal; and said polarization converter is directly integrated in said feeder waveguide.

5. In a receiver for counterclockwise and clockwise circularly polarized microwave signals comprising a receiving antenna with a feeder system including a feeder waveguide, a polarization converter for converting received circular to linear polarized signals, a polarization filter and a converter circuit means, connected to the output of said feeder system for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter comprises a dielectric insert provided in said feeder waveguide and having a shape such that the circularly polarized received signals are converted to linearly polarized signals, with said dielectric insert being a cylindrical core inserted into the antenna-side input of said feeder waveguide and with said insert being provided at its peripheral surface with two opposing longitudinally oriented flattened portions whose normals form an angle of 45° with the x axis or the y axis determined by the orthogonal axes where the coupling pins are arranged.

6. In a receiver for counterclockwise and clockwise circularly polarized microwave signals comprising a receiving antenna with a feeder system including a feeder waveguide, a polarization converter for converting received circular to linear polarized signals, a polarization filter and a converter circuit means, connected to the output of said feeder system for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions, and said feeder waveguide is provided with tuning markers formed by a mechanical deformation of the wall of said feeder waveguide and which serve to electrically match the filter parameters and the cross-polarization of the receiver; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter is directly integrated in said feeder waveguide.

7. In a receiver for counterclockwise and clockwise circularly polarized microwave signals comprising a receiving antenna with a feeder system including a feeder waveguide, a polarization converter for converting received circular to linear polarized signals, and a polarization filter, and a converter circuit means, connected to the output of said feeder system for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions, with said bandpass filter being formed by a plurality of coupling apertures which are disposed in said feeder waveguide and provided with coupling openings in the form of circles; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter is included in said means for coupling the energies of the waveguide modes.

8. In a receiver for counterclockwise and clockwise circulary polarized microwave signals comprising a receiving antenna with a feeder system including a feeder waveguide, a polarization converter for converting received circular to linear polarized signals, and a polarization filter, and a converter circuit means, connected to the output of said feeder system for converting the microwave signals of both polarization directions from the high frequency to the intermediate frequency plane, the improvement wherein: a portion of said feeder waveguide belonging to said feeder system of said receiving antenna is a bandpass filter which is effective for both said polarization directions; said converter circuit means is disposed on a microstripline substrate whose input is connected with the output of said feeder waveguide; the output end of said feeder waveguide is disposed on and normal to the ground plane surface of said microstripline substrate and is electrically connected therewith; said input of said microstripline substrate comprises coupling means disposed on said substrate for coupling the energies of the waveguide modes of both polarization directions out of said feeder waveguide and into said converter circuit means; said coupling means includes a plurality of coupling pins which extend through said microstripline substrate and axially into said feeder waveguide and which have their base points connected to respective microstriplines disposed on the surface of said substrate opposite said ground plane surface, selected ones of said microstriplines emanating from said base points of said coupling pins being connected together to provide the information from the clockwise and counterclockwise circularly polarized received signal; and said polarization converter is included in said means for coupling waveguide modes.

9. In a receiver for counterclockwise and clockwise circularly polarized microwave signals comprising a receiving antenna with a feeder system including a feeder waveguide, a polarization converter for converting received circular to linear polarized signals, a polarization filter and a converter circuit means, connected to the output of said feeder system for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter comprises a dielectric insert provided in said feeder waveguide and having a shape such that the circularly polarized received signals are converted to linearly polarized signals, said dielectric insert being a cylindrical core inserted into the antenna-side input of said feeder waveguide and having a cross section which is reduced in the direction toward the interior of said feeder waveguide.

10. In a receiver for counterclockwise and clockwise circularly polarized microwave signals comprising a receiving antenna with a feeder system including a feeder waveguide, a polarization converter for converting received circular to linear polarized signals, and a polarization filter, and a converter circuit means, connected to the output of said feeder system for converting the microwave signals of both polarization directions from the high frequency to the intermediate frequency plane; the improvement wherein: a portion of said feeder waveguide belonging to said feeder system of said receiving antenna is a bandpass filter which is effective for both said polarization directions, and said feeder waveguide is provided with tuning markers formed by a mechanical deformation of the wall of said feeder waveguide and which serve to electrically match the filter parameters and the cross-polarization of the receiver; said converter circuit means is disposed on a microstripline substrate whose input is connected with the output of said feeder waveguide; said input of said microstripline substrate comprises means disposed on said substrate for coupling the energies of the waveguide modes of both polarization directions out of said feeder waveguide and into said converter circuit means; and said polarization converter is included in said means for coupling waveguide modes.

11. A receiver as defined in claim 1 or 2 wherein said bandpass filter is formed by a plurality of coupling apertures which are disposed in said further portion of said feeder waveguide and provided with coupling openings.

12. A receiver as defined in claim 1 wherein said polarization converter comprises a dielectric insert provided in said feeder waveguide and having a shape such that the circularly polarized received signals are converted to linearly polarized signals.

13. A receiver as defined in claim 5 or 12 wherein said cylindrical, dielectric core has a cross section which is reduced in the direction toward the interior of said feeder waveguide.

14. A receiver as defined in claim 3 or 8 wherein four of said coupling pins are provided with two of said coupling pins being arranged on a common horizontal axis and two of said coupling pins being arranged on a common vertical axis of said feeder waveguide, each of said coupling pins being bent, in the feeder waveguide, at an angle radially to the associated wave propagation direction, and each of said coupling pins being provided with an axial extension which acts as a stub and is oriented toward the interior of said feeder waveguide.

15. A receiver as defined in claim 3 or 8 wherein said coupling means further includes a ring hybrid means, connected to said connected together microstripline emanating from said base points, for providing a signal at a respective one of its two outputs corresponding to the information from the clockwise or counterclockwise circularly polarized received signals, respectively.

16. A receiver as defined in claim 3 or 8 wherein said coupling means further includes a ring hybrid means, connected to said connected together microstriplines emanating from said base points, for normally providing a signal at a respective one of its two outputs corresponding to the information from the clockwise or counterclockwise circularly polarized received signals, respectively; wherein only one of said converter circuit means is provided for the received signals from both polarization directions, with said one converter circuit means being connected to one of said outputs of said ring hybrid means; and further comprising a 0°/180° phase shifter connected ahead of one input of said ring hybrid so that, depending on the switching state of said 0°/180° phase shifter, either the signal with the information from the clockwise circularly polarized received signal or with the information from the counterclockwise circularly polarized received signal appears at said one output of said ring hybrid means.

17. A receiver as defined in claim 16 wherein said 0°/180° phase shifter is a ferrite element arranged adjacent the microstripline attached to one input of said ring hybrid means and being provided with a magnetization coil, the magnetization of said ferrite element being reversible by a current pulse flowing through a said magnetization coil.

18. A receiver as defined in claim 11 wherein: said receiving antenna is a Cassegrain antenna; said dielectric core extends outside of said feeder waveguide where it widens to a funnel-lke shape; and the end surface of said dielectric core is designed as a subreflector for said antenna.

19. A receiver as defined in claim 18 wherein the exterior of the funnel-shaped portion of said dielectric core which extends from said feeder waveguide is provided with a metallized groove structure.

20. A receiver as defined in claim 18 wherein said dielectric core is provided in the antenna-side end of said feeder waveguide and projects from said feeder waveguide in the form of a dielectric rod radiator.

21. A receiver as defined in claim 20 further comprising: a stable, dielectric hollow sheath disposed on the antenna side end of said feeder waveguide and enclosing said dielectric rod radiator, and a shell, which serves as a subreflector, terminating the open end of said sheath, which widens toward said subreflector.

22. A receiver as defined in claim 21 wherein the space within said dielectric sheath is filled with a foamed dielectric substance whose dielectric constant is substantially lower than that of said dielectric core.

* * * * *